US005445059A

United States Patent [19]

Lawrence et al.

[11] Patent Number: 5,445,059

[45] Date of Patent: Aug. 29, 1995

[54] METHOD FOR FORMING PAPER-WRAPPED EMULSION EXPLOSIVE CARTRIDGES

[75] Inventors: Lawrence D. Lawrence, Sandy; John B. Halander, Salt Lake City, both of Utah

[73] Assignee: Dyno Nobel Inc., Salt Lake City, Utah

[21] Appl. No.: 220,051

[22] Filed: Mar. 30, 1994

[51] Int. Cl.[6] ..... F42B 7/02

[52] U.S. Cl. ..... 88/12; 86/10; 86/11; 86/32

[58] Field of Search ..... 86/10, 11, 12, 32

[56] References Cited

U.S. PATENT DOCUMENTS

| | | | |
|---|---|---|---|
| 2,327,885 | 8/1943 | Grace et al. | 113/89 |
| 2,564,695 | 8/1951 | Johnson, Jr. et al. | 102/43 |
| 3,282,146 | 11/1966 | Baker | 86/10 |
| 3,783,735 | 3/1974 | Murphy | 86/20 R |
| 4,790,890 | 12/1988 | Miller | 102/282 X |
| 4,867,920 | 9/1989 | Sudweeks et al. | 264/3.3 X |

*Primary Examiner*—Peter A. Nelson

[57] ABSTRACT

The invention is a novel method for forming paper-wrapped cartridges of gassed emulsion explosive comprising the steps of (a) forming a water-in-oil emulsion at an elevated temperature, (b) chemically gassing the emulsion to form a sensitizing, uniform distribution of gas bubbles throughout the emulsion, (c) shaping the chemically gassed emulsion into a continuous rod of emulsion, (d) continuously wrapping the rod of emulsion with a paper packaging material that is shaped circumferentially around the rod and sealed longitudinally with an adhesive that can withstand the elevated temperature of the emulsion and is water-resistant, (e) cutting the paper-wrapped emulsion rod into individual cartridges, and (f) cooling the cartridges by contacting them with a liquid, preferably water, at a temperature below the elevated temperature of the emulsion.

7 Claims, 1 Drawing Sheet

METHOD FOR FORMING PAPER-WRAPPED EMULSION EXPLOSIVE CARTRIDGES

The present invention relates to packaged explosives and a method of manufacture thereof and more particularly to a method for forming paper-wrapped emulsion explosives cartridges. The term "emulsion" as hereafter used shall mean a water-in-oil emulsion having a continuous organic fuel phase and a discontinuous oxidizer solution phase dispersed as fine droplets throughout the fuel phase. The term "explosive" shall mean a detonable composition which can be either cap-sensitive or non-cap-sensitive, as desired. The term "cartridge" shall refer to a cylindrical rod of explosive of any desired length having an outer wrapping and a diameter of generally 50 mm or less and a length of generally 406 mm or less, although larger sizes of cartridges also can be made by the method described herein. By "paper-wrapped" is meant that the outer wrapping of the cartridge is composed of paper.

BACKGROUND OF THE INVENTION

Emulsion explosives are well-known in the art; see, for example, U.S. Pat. Nos. 4,356,044; 4,322,258; 4,141,767; and 3,161,551. Emulsion explosives cartridges also are well-known from U.S. Pat. Nos. 4,790,890 and 4,867,920. Emulsions generally are formed at elevated temperatures, as required to keep the oxidizer salt(s) in solution. It has been found, however, that once the emulsion explosive is formed at the elevated temperature, it should be cooled rapidly to ambient temperature in order to preserve its long-term storage stability. Moreover, where such emulsion explosives are chemically gassed for sensitivity purposes, the formulated emulsion should be cooled quickly to minimize shrinkage or potential coalescence of the chemically generated gas bubbles within the emulsion. Accordingly, in forming chemically gassed, emulsion explosives cartridges, it is desirable to cool each cartridge as quickly as possible.

Packaged explosives or cartridges have been manufactured for many years. For example, dynamites have been paper-wrapped in conventional machines to form symmetrical cylindrical cartridges having crimped or "squared" ends that form planer surfaces perpendicular to the axis of the cylindrical cartridge. Packages in this form are convenient for handling, and when loaded into boreholes, have good end-to-end contact which facilitates cartridge-to-cartridge propagation upon detonation. The rigidity of the paper cartridge is advantageous for handling in certain applications.

Aqueous slurry explosives, which comprise a thickened gel of oxidizer salt solution throughout which a fuel is dispersed or dissolved, primarily have been packaged in a sausage-like form in a flexible tubing such as polyethylene having clipped ends. A process and apparatus for packaging slurry explosives in a sausage-like form is described in U.S. Pat. No. 3,783,735. The clipped ends, however, tend to interfere with close end-to-end contact, and thus clipped polyethylene tubes are not as desirable in certain applications as crimped paper tubes in assuring reliable detonation propagation from stick to stick in a loaded borehole. The handling characteristics of a flexible tube also may not be as desirable in some applications as that of paper cartridges.

More recently, emulsion explosives have been packaged either in crimped paper tubes, similar to that used for packaging dynamite, or in sausage-like clipped tubes, similar to that used for packaging slurry explosives. For certain applications and for the reasons set forth above, it is desirable to package emulsion explosives in symmetrical paper-wrapped cylinders having squared ends formed by crimping or other means. U.S. Pat. No. 4,790,890 discloses a method of manufacturing a chemically gassed emulsion explosives cartridge by first forming a cartridge of emulsion in flexible tubing and then over-wrapping the tube with an additional packaging material such as paper. This method has the disadvantage of requiring two separate packaging steps and materials with their attendant costs. U.S. Pat. No. 4,867,920 discloses another method for packaging chemically gassed emulsion cartridges with paper packaging. In this method, a chemically gassed slab of emulsion is immersed in water for cooling and then is cut into separate strips that then can be individually wrapped with paper. This requires, however, considerable handling of individual cartridges. The present invention overcomes these problems by providing a method for forming a paper-wrapped emulsion explosives cartridge in a continuous manner. The present invention allows for the cartridge to be cooled, such as by immersion in a water bath, after it has been paper-wrapped, and this method of "paper-wrapping into water" is precisely what the above-referenced prior art was trying to avoid, since heretofore it was not possible to paper-wrap a gassed cartridge and then subject it to water cooling because the paper or the adhesive or both were not compatible with water.

Emulsion explosives generally require some form of uniform distribution of gas bubbles for adequate detonation sensitivity. A common method of introducing sensitizing gas bubbles is incorporating a uniform distribution of void containing materials, such as glass or organic microspheres or perlite, throughout the emulsion. These void-containing materials tend not to migrate or coalesce once dispersed throughout the emulsion, and therefore, packaging of emulsions containing these materials is relatively simple.

Another means of sensitizing emulsion explosives is by the introduction of ingredients which react chemically to produce gas bubbles. Chemical gassing is a less expensive means of sensitization than the use of hollow microspheres and is therefore preferred from a cost standpoint. These free, discrete gas bubbles tend to migrate and/or coalesce in the emulsion or escape from the emulsion, however, unless inhibited by the viscosity of the emulsion itself. Because emulsions are relatively fluid at their elevated temperatures, it is important to cool them quickly and render them sufficiently viscous to minimize these problems. The invention allows for chemically gassed emulsion explosives to be paper-wrapped and then quickly cooled, a combination heretofore not available.

SUMMARY OF THE INVENTION

The invention is a novel method for forming paper-wrapped cartridges of gassed emulsion explosive comprising the steps of (a) forming a water-in-oil emulsion at an elevated temperature, (b) chemically gassing the emulsion to form a sensitizing, uniform distribution of gas bubbles throughout the emulsion, (c) shaping the chemically gassed emulsion into a continuous rod of emulsion, (d) continuously wrapping the rod of emulsion with a paper packaging material that is shaped circumferentially around the rod and sealed longitudinally with an adhesive that can withstand the elevated temperature of the emulsion and is water-resistant, (e) cutting the paper-wrapped emulsion rod into individual cartridges, and (f) cooling the cartridges by contacting them with a liquid, preferably water, at a temperature below the elevated temperature of the emulsion.

By properly selecting the type of paper wrapping and adhesive, a stable cartridge of gassed emulsion explosive can be obtained. This is accomplished with minimal migration and coalescence of the gas bubbles and consequent loss of detonation sensitivity. Preferably the ends of the cartridge are closed or sealed prior to cooling by either crimping or clipping the ends.

DETAILED DESCRIPTION OF THE INVENTION

Figure 1:
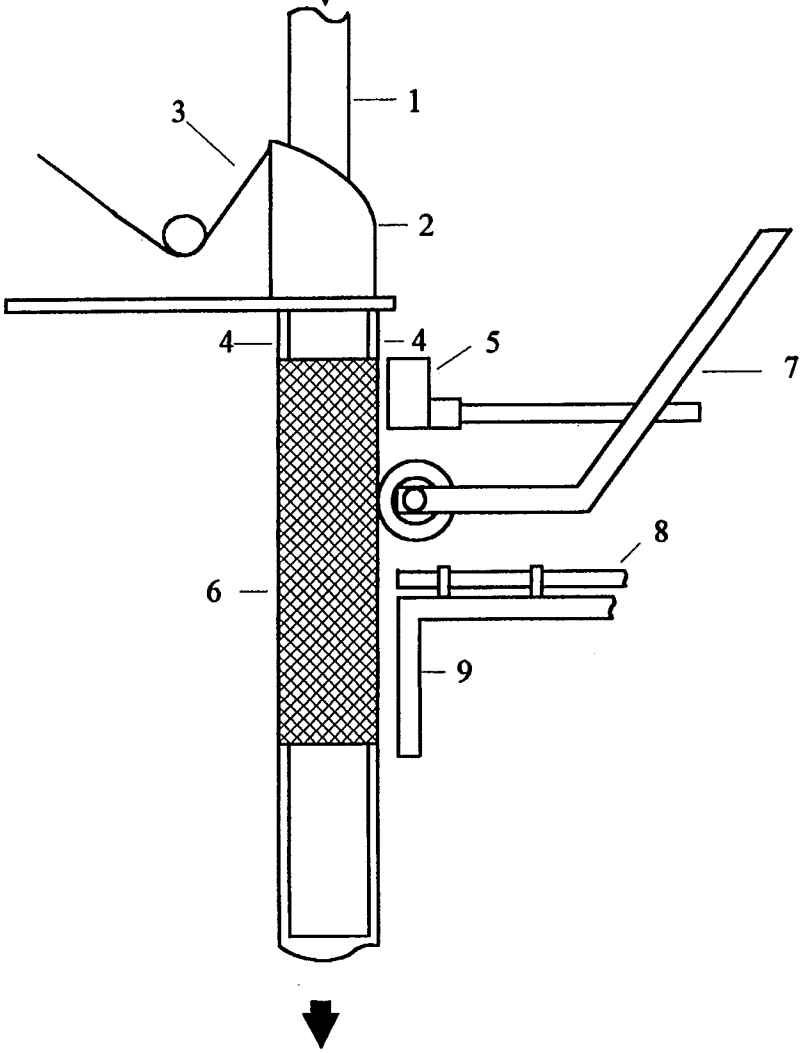
FIG. 1 shows paper-wrapping and sealing apparatus that can be employed in the method of the invention.

In FIG. 1, the pre-formed and chemically gassed emulsion product is forced or pumped through the product mandrel 1 in the direction shown by the arrows. Circumscribing the product mandrel is a folding head 2 that receives a continuous supply of paper strip 3 and shapes the strip to form a cylindrical shell 4 of paper around the mandrel. The paper strip has an adhesive pre-applied to one side or to one of its edges, and when shaped around the mandrel, the adhesive-applied side or edge overlaps the opposite edge of the paper strip to form a longitudinal adhesive strip running the length of the paper shell. A hot air nozzle 5 is positioned adjacent to the adhesive strip portion of the paper shell to provide a jet of hot air that heats and melts the adhesive for purposes of sealing together the overlapping edges of the paper strip. Preferably, a sizing cylinder 6 provides proper sizing for the paper shell and also provides a solid support to resist the jet of hot air from the sealing nozzle and also the seal depression roller 7 that applies pressure to the adhesive seal. Preferably, the seal is cooled by a water quench line 8 and is further cooled by a cooling air nozzle 9. Thereafter (not shown), the emulsion explosive exits from the product mandrel and expands to fill the pre-formed and now sealed paper shell, and the filled shell, now a continuous rod of emulsion explosive, then can be cut into individual cartridges, preferably having clipped or crimped ends, as is known in the art. By properly selecting the paper and adhesive, the paper-wrapped cartridge can withstand immersion in a cooling bath or spraying by a cooling liquid medium, preferably water, which is used to cool the cartridge at a desired rate and to a desired temperature.

The paper wrapping material for use in the present invention preferably has the following properties: wet strength, water resistance, hydrocarbon or oil resistance, flexibility and slight elasticity. The paper preferably is selected from the group consisting of vegetable parchments and styrene-based latex substrates. The paper wrapping material is provided as a continuous strip of flat paper, preferably coiled, having a width preferably of about 3.75 times the diameter of the cartridge.

The adhesive is pre-applied to the paper wrapping material along one side or one edge of the strip and preferably runs the entire length of the paper strip. When the paper wrapping material is shaped around the rod of emulsion, an adhesive strip of about 9.5 mm overlaps the opposite edge of the paper strip. The adhesive must retain its sealing power after being subjected to the elevated temperature of the emulsion and to direct contact with the cooling medium, preferably water. Preferably, the adhesive is activated when subjected to a jet of hot air at a temperature of 120° C. or greater. The adhesive preferably is selected from the group consisting of modified water-based copolymers and solvent-based gels.

The compositions of the emulsion explosives comprise an immiscible organic fuel forming the continuous phase of the composition in an amount generally from about 3% to about 12% by weight of the composition; emulsifying agent; inorganic oxidizer salt solution (or melt) forming the discontinuous phase of the composition, generally comprising inorganic oxidizer salt in an amount from about 45% to about 95%; trace gassing ingredients and water and/or water-miscible organic liquids preferably in an amount of from about 2% or less to about 15%. Optionally, the compositions can be formulated without any water. The "water-in-oil" emulsifying agent is employed generally in an amount of from about 0.1% to about 5% by weight. Preferred organic fuels are mineral oil, No. 2 fuel oil, paraffin waxes, microcrystalline waxes and mixtures thereof. The oxidizer salts are selected from the group consisting of ammonium, alkali and alkaline earth metal nitrates, chlorates and perchlorates. Ammonium nitrate is usually the predominant oxidizer salt, and lesser amounts of sodium nitrate or calcium nitrate are commonly used. A portion of the total oxidizer salt may be added in particle or prill form.

The packaged explosives are reduced from their natural densities by addition of a density reducing agent(s) in an amount sufficient to decompose and reduce the density to within the range of from about 0.9 to about 1.4 g/cc. Although glass or organic microspheres, perlite or other void containing materials can be used as part of the density reducing agent, the method of the present invention requires appreciable density reduction by means of chemical gassing as is known in the art.

The emulsion explosives may be formulated in a conventional manner. Typically, the oxidizer salt(s) first is dissolved in the water (or aqueous solution of water and miscible liquid fuel) at an elevated temperature of from about 25° C. to about 110° C. or higher, depending upon the crystallization temperature of the salt solution. The aqueous solution then is added to a solution of the emulsifying agent and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. Solid ingredients, if any, then are added and stirred throughout the formulation by conventional means. The gassing agents are added and uniformly mixed throughout the formulation. These agents react or decompose to produce finely dispersed gas bubbles. The formulation process preferably is accomplished in a continuous manner. The gassed or gassing emulsion then is forced or pumped into the product mandrel 1 shown in FIG. 1.

The resulting paper-wrapped cartridges then are cooled by spraying with a cool liquid medium or preferably by immersion into a cooling bath, which preferably is water or an aqueous salt solution at a temperature of preferably from about 2° C. to about 30° C. The cooling bath can be an elongated trough of up to 100 m or more in length. The cartridges preferably are cooled to a center or core temperature of from about 5° C. to about 40° C. This generally can be accomplished in about 5 to 20 minutes of cooling time. The sizes of the cartridge can vary as desired but preferably are in the ranges of from about 20 mm to about 45 mm in diameter and from about 204 mm to about 406 mm in length.

The present invention further is illustrated by the following examples in Table I, which were prepared in accordance with the above-described methods.

The process parameters for the examples were as follows:

1. The emulsion was formed at an elevated temperature of about 90° C.

2. The cooling water was maintained at a temperature of about 2°–3° C. and was applied through a spray nozzle.

3. The cartridge size was 32 mm in diameter by 406 mm in length. The ends of the cartridge were clipped with aluminum wire.

The residence time in the spray bath was about 10 minutes.

5. The cartridges in Examples A and B were wrapped with styrene-based latex substrate paper to which a modified water-based copolymer adhesive was applied. The adhesive was an ethylene vinyl based latex from Frank Scott Packaging.

The compositions in the examples had the detonation properties set forth in the Table.

The emulsion explosives cartridges of the present invention can be used conventionally, and thus they can be used in most applications where other packaged products, such as dynamites are used.

While the present invention has been described with reference to certain illustrative examples and preferred embodiments, various modifications will be apparent to those skilled in the art and any such modifications are intended to be within the scope of the invention as set forth in the appended claims.

TABLE I

| Composition Ingredients (parts by weight) | A | B |
|---|---|---|
| Ammonium Nitrate | 69.70 | 68.33 |
| Sodium Nitrate | 13.06 | 12.66 |
| Water | 10.26 | 9.97 |
| Emulsifying Agent[a] | 1.92 | 1.86 |
| Oil[b] | 1.28 | 1.24 |
| Wax[c] | 3.20 | 3.10 |
| Gassing Agent[d] | 0.58 | 0.34 |
| Microballoons[e] | — | 2.50 |

TABLE I-continued

| Composition Ingredients (parts by weight) | A | B |
|---|---|---|
| Density (g/cc) | 1.12 | 1.15 |
| Detonation Results (5° C.) | | |
| Minimum Booster, 32 mm[f] | 3/2 | 3/2 |
| Detonation Velocity (km/sec) | 4.4 | 4.7 |

[a]Sorbitan monooleate
[b]Mineral oil
[c]Microcrystalline wax
[d]Sodium nitrite/catalyst solution
[e]K20 from 3M Company
[f]The first number indicates a detonation with the cap number listed. The second number indicates a failure with the cap number listed. The cap number indicates the number of grains of PETN in the base charge.

What is claimed is:

1. A method for forming filled, paper-wrapped cartridges of gassed emulsion explosive comprising (a) forming a water-in-oil emulsion at an elevated temperature, (b) chemically gassing the emulsion to form a sensitizing, uniform distribution of gas bubbles throughout the emulsion, (c) shaping the chemically gassed emulsion into a continuous rod of emulsion, (d) continuously wrapping the rod of emulsion with a paper packaging material that is shaped circumferentially around the rod and sealed longitudinally with an adhesive that can withstand the elevated temperature of the emulsion and is water-resistant, (e) cutting the paper-wrapped emulsion rod into individual cartridges, and (f) cooling the cartridges by contacting them directly with a liquid at a temperature below the elevated temperature of the emulsion.

2. A method according to claim 1 comprising the additional step of closing each end of the cartridges prior to cooling them.

3. A method according to claim 1 wherein the paper packaging material is selected from the group consisting of vegetable parchments and styrene-based latex substrates.

4. A method according to claim 1 wherein the adhesive is selected from the group consisting of modified water-based copolymers and solvent-based gels.

5. In a method of producing filled, individually-wrapped cartridges of water-in-oil emulsion explosive that is sensitized by chemically-produced gas bubbles, the improvement comprising wrapping the cartridges with paper, sealing the paper wrapping around the cartridge with an adhesive that can withstand the elevated temperature of the emulsion explosive and is water-resistant and then cooling the cartridges by contacting them directly with a liquid at a temperature lower than the temperature of the emulsion explosive.

6. An improved method according to claim 5 wherein the paper is selected from the group consisting of vegetable parchments and styrene-based latex substrates.

7. An improved method according to claim 6 where in the adhesive is selected from the group consisting of modified water-based copolymers and solvent-based gels.

* * * * *